United States Patent [19]

Janke et al.

[11] Patent Number: 4,495,859

[45] Date of Patent: Jan. 29, 1985

[54] COVER ASSEMBLY FOR VERTICAL EXHAUST PIPES

[75] Inventors: Edwin R. Janke, Crystal Lake; Earl Conrad, Lake in the Hills, both of Ill.

[73] Assignee: Mercury Metal Products, Inc., Schaumburg, Ill.

[21] Appl. No.: 516,678

[22] Filed: Jul. 25, 1983

[51] Int. Cl.[3] ..... F01N 7/00; F23L 17/02

[52] U.S. Cl. ..... 98/59; 137/514; 137/527.6; 137/DIG. 5

[58] Field of Search ..... 137/514, 527.6, DIG. 5; 98/59, 122; 251/64

[56] References Cited

U.S. PATENT DOCUMENTS 2,694,358 11/1954 Taylor ..... 98/59

4,255,928 3/1981 Jones et al. ..... 98/59 X

*Primary Examiner*—Martin P. Schwadron

*Assistant Examiner*—Robert G. Nilson

*Attorney, Agent, or Firm*—Silverman, Cass & Singer, Ltd.

[57] ABSTRACT

A gravity actuated protective cover assembly to be secured upon the upstanding exhaust stack of an internal combustion engine overlying the open end of the stack. The cover assembly includes a clamp member for securement of the assembly to the stack and a pair of support straps connected to the clamp member on which a pivotal cover member and support arm are mounted. A bumper member is mounted on the support straps to absorb the energy of impact at the fully open and closed positions of the cover member on the stack.

12 Claims, 3 Drawing Figures

COVER ASSEMBLY FOR VERTICAL EXHAUST PIPES

BACKGROUND OF THE INVENTION

This invention relates to a gravity actuated protective cover assembly employed to expose or close the open end of an upright exhaust pipe of an internal combustion engine and more particularly, to an improved cover assembly having novel means for absorbing energy shock at opening and closing of the cover on the stack.

The herein invention achieves important advantages over the cover devices described in U.S. Pat. Nos. 2,983,216, 4,059,045, and 4,255,928. A protective cover assembly of the type described in said patents normally is mounted on the exhaust stack of the engine proximate the open upper end of the stack. The cover member is pivotally mounted on the assembly for movement from a normal position overlying said open end so as to close the same to a second position exposing said open end. In the normal closed position of the cover member, rain, snow or other debris is prevented from entering the stack. During operation of the engine, exhaust gases rise in the stack to impinge against the cover member with sufficient force to pivot the cover member fully to an open position and permit discharge of the exhaust gases through the opened end of the stack. Past experience with such cover movement has been occasioning of considerable shock at the fully open and closed positions of the cover member by reason of the pivotal movement of a weighted cover member such as commonly used in such assemblies. During alternate high speed and low speed operation of the engine such a weighted cover member is pivoted successively between open and closed positions thereof with accompanying substantial impact shocks. Even at idle speed of the engine, the cover will flutter between closed and slightly open positions with accompanying impact shocks.

In the prior art patents, the cover assemblies have been constructed using a clamp formed of two metal straps which are welded together face to face for a short portion of their combined length. At a second portion of their combined length, the straps form a loop sized to encircle the exhaust stack. A plastic bumper member is mounted upon the welded portion of the straps in position to absorb impact shock and reduce the noise as the pivotal cover pivots to said open and closed positions on the end of the stack. In some cases, after extended use the repeated shock of impacts at the open and closed positions of the cover has generated very strong vibrations which can rupture the welded junction, particularly with larger covers employed in heavy duty vehicles.

The improved cover assembly of this invention eliminates welding of the support straps to each other and thereby prevents breakage of the cover assembly due to such sustained impact shock of the cover member for extended periods of use.

SUMMARY OF THE INVENTION

A pivotal cover assemblly for upstanding exhaust stacks or the like of engines includes a clamping member for securement to the exhaust stack mounting a pair of mirror-image, spaced apart support straps on which a pivoting cover member and support arm are mounted. Each of the support straps is rigidly secured, as by welding, to the clamp member, but the support straps do not require welding one to the other.

Mounted on the spaced support straps is a resilient bumper member located to engage the support arm, absorb impact shock and eliminate noise as the pivotal cover reaches its open and closed positions. The extended, spot welded surface of the support straps upon the clamp member results in eliminating the welds from the direct line of the impact of the cover support arm with the bumper member at fully open and closed cover positions so as to increase the operational life of the cover assembly.

The bumper member can be fabricated so that a portion thereof is received between the support straps for mounting the same.

DESCRIPTION OF THE PREFERRED EMBODIMENTS

Figure 1:
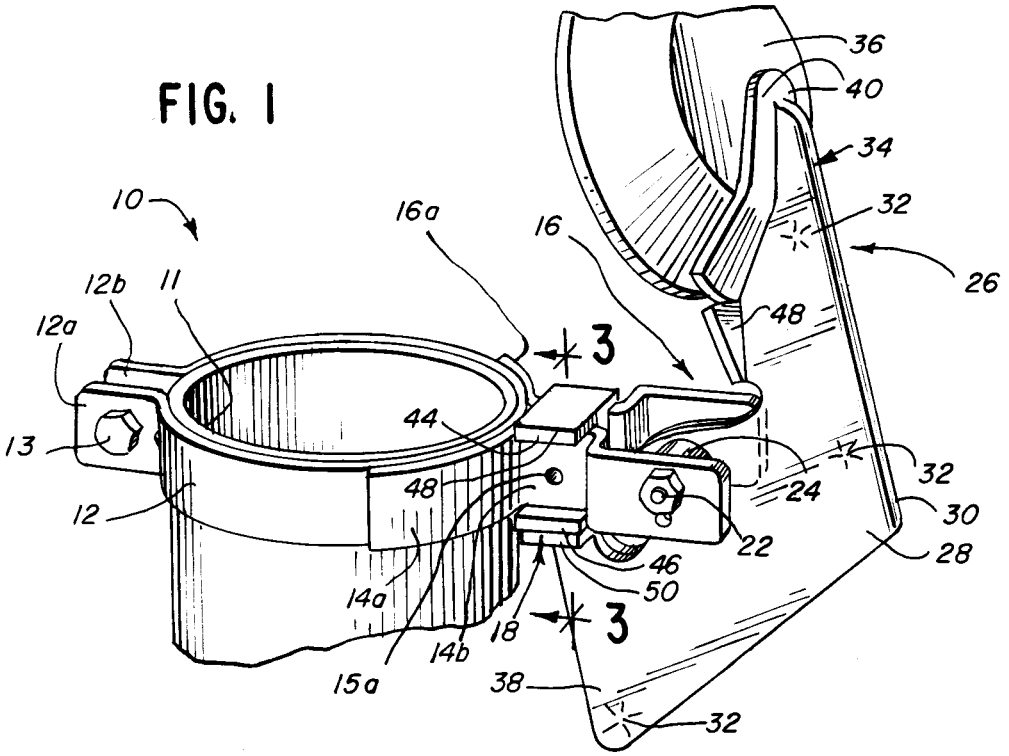
FIG. 1 is a perspective view of a cover assembly embodying the invention installed upon an upstanding exhaust stack of an engine and illustrating the fully open position of the pivotal cover member and supporting arm.
Figure 2:
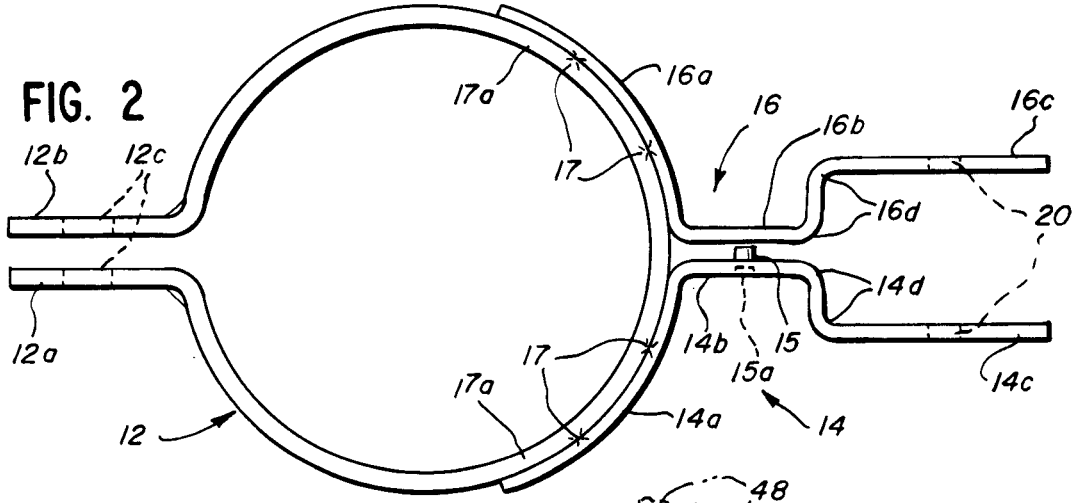
FIG. 2 is a plan view of the clamp member connected to a pair of supporting straps of the cover assembly of FIG. 1.

Referring to FIG. 1, the cover assembly embodying the invention is designated generally by the reference character 10 and is illustrated mounted on an upstanding exhaust stack 11. In assembly 10, a clamp member 12 fabricated from a single metal strap is formed in a generally looped configuration conforming to and encircling the stack 11. Clamp 12 includes extended flange ends **12*a* and 12*b* which are apertured at 12*c* to accept fastening means, such as bolt 13, for tightening the clamp member 12 around stack 11. As seen in FIG. 2, a pair of metal support straps 14 and 16 include respective arcuate portions 14*a* and 16*a* which are welded to the conforming outer surface of clamp member 12 at a plurality of representative welds 17. The straps 14 and 16 include respective neck portions 14*b* and 16*b* which are bent at their connection to respective arcuate portions 14*a* and 16*a*. The neck portions 14*b* and 16*b* are spaced apart a short distance to provide a supporting means on which a bumper member 18** is mounted.

As seen in FIG. 2, the arcuate portions **14*a* and 16*a* are of similar length and are spot-welded face-to-face with conforming arcuate portions 17*a* of the clamp member 12. It will be seen that the thusly engaged arcuate lengths of the strap members and clamp member are sufficient to enable a multiplicity of welds 17 to adequately maintain the securement of said arcuate lengths. Further, it will be seen that welds 17 are spaced adequately remote from the neck portions 14*b* and 16*b* and the bumper 18 so that shock impact of the cover member 36 of assembly 10 at fully open and closed positions is not directly impinged on said welds 17. Thus, the welds 17** are not subject to rupture as occasioned in the referenced prior art assemblies.

Straps 14 and 16 further include respective portions **14*c* and 16*c* which are connected to respective neck portions 14*b* and 16*b* by outward bends 14*d* and 16*d* of approximate right angles. In the device 10, the strap portions 14c and 16c function as a bifurcated end of the support strap assembly joined to the clamp member 12**.

The portions 14c and 16c include aligned apertures 20 to receive a rivet or bolt 22 for supporting the bearings of a pivot structure 24 which permits free rocking of the balance arm 26. A preferred pivot structure including split, plastic bearings is more fully described in the referenced patent No. 4,380,952.

Referring again to FIG. 1, the balance arm 26 is made from a pair of identical sheet metal stampings 28 and 30 which are welded together face-to-face at several locations, such as shown at 32. Alternatively, the balance arm 26 can be formed by folded-over plate. The balance arm 26 includes a front nose 34 which carries the cover member 36 and a rear counterweight vane 38. Integral flanges 40 bent outwardly from the stampings 28 and 30 are welded to the top of the cover member 36.

The cover member 36 has a shallow, inverted dish-like configuration which covers, without touching, the upper end of the stack 11 when the engine is not operating because the weight of the cover 36 and the front end of the balance arm 26 is greater than the weight of the rear vane 38 on the opposite side of the pivot structure 24. When the engine is operating, exhaust gases impel the cover 36 from the closed position to the open position in a clockwise direction about the pivot 24, as illustrated in FIG. 1.

Figure 3:
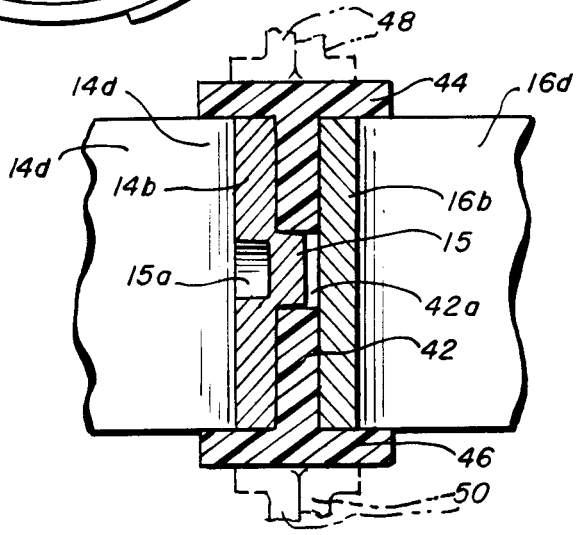
FIG. 3 is a fragmentary, cross-sectional view taken along line 3—3 of FIG. 1 and in the indicated direction.

Referring to FIGS. 1 and 3, the bumper member 18 is mounted at the location of the opposing neck portions 14b and 16b of the respective support straps 14 and 16. A cross-section of the bumper member 18 features an I-shaped configuration which includes a central stud 42 and arm parts 44 and 46 formed at opposing ends of the stud 42. The stud 42 is dimensioned to fit between the neck portions 14b and 16b, and the arm parts 44 and 46 are respectively positioned above and below the edges of the opposite ends of the neck portions 14b and 16b. Thus, arm 44 has a flat surface facing upward and the arm 46 has a flat surface facing downward in the normally employed orientation as illustrated in FIGS. 1 and 3. In order to secure the bumper member 18 in fixed position between the neck portions 14b and 16b, the stud 42 can be provided with an aperture 42a into which is inserted an anchoring pin 15 projecting from one of the neck portions 14b. The anchoring pin 15 can be fabricated by a simple punching operation resulting in a cavity 15a exposed on the outer surface of neck portion 14b. Thus, the neck portions 14b and 16b cooperate to function as seating means for bumper 18.

The bumper member 18 preferably is molded or fabricated from resilient, plastic material, such as nylon or polytetrafluoroethylene, which can eliminate noise from impacts thereagainst by the balance arm 26.

The movement of the balance arm 26 is limited by the bumper member 18 in cooperation with stop means provided on the balance arm to prevent contact by the cover 36 with the extremity surface of the stack 11 and to prevent contact by the vane 38 with the support straps 14 and 16. The stop means are provided by outwardly bent, integral tabs 48 and 50 formed on each of the stampings 28 and 30 of the balance arm 26. The pivotal motion of the balance arm 26 is limited in the counter clockwise direction by engagement of tab 48 with the upper surface of the arm 44 as shown in FIG. 3. Motion in the clockwise direction is limited by engagement of the tab member 50 on the vane 38 with the lower surface of the arm 46 as illustrated in FIGS. 1 and 3. Since the bumper member 18 is supported on the neck portions 14b and 16b which are not welded or otherwise joined, the stress of the repeated impacts of the balance arm 26 upon the bumper member 18 does not result in a failure of a joint between the neck portions of prior cover assemblies.

Variations in dimension and configuration of cooperating parts can be made without departing from the scope of the invention.

I claim:

1. A gravity actuated protective cover assembly adapted to be secured upon the upstanding exhaust stack of an internal combustion engine to prevent entry of extraneous matter therein through the open end thereof during the inoperative condition of the engine and comprising:

A. a clamp member adapted to be secured to the exhaust stack and including clamping means therefor;

B. a pair of separate support straps, means fixedly connecting said straps to said clamp member, said straps extending laterally from the clamp member in transversely spaced apart relationship to each other for the full extent of said straps laterally of said clamp member, the support straps having a pivot structure mounted thereon;

C. a balance arm mounted on said pivot structure for pivotal movement about said pivot structure in a vertical plane, the balance arm having a cover member connected to a front end thereof and an opposing counterweight vane, the vane and cover member being on respective opposite sides of the pivot structure to enable pivotal movement of the balance arm between a first position which is to dispose the cover member over the open end of the exhaust stack, and a second position having the cover member substantially rotated away from the stack to expose said open end;

D. the balance arm being heavier on the cover member side of the pivot structure than on the vane side of the pivot structure so that the normal condition of the balance arm is with the cover member in the first of said positions when the engine is not operating;

E. said straps including flange portions spaced apart to form a bifurcated end formation in which the pivot structure is mounted with said balance arm straddled by said flanged portions, said straps further including spaced opposing neck formations between said end formation and said clamp member, said neck formations defining a space therebetween and having bumper means mounted thereon for limiting said pivotal movement and preventing engagement of said cover member with the open end of the stack.

2. The cover assembly as claimed in claim 1 in which said clamp member includes a looped portion adapted to be mounted to substantially encircle and engage the peripheral surface of said stack, said looped portion having opposed ends, said clamping means engaging said ends for a selective inward drawing thereof annd a tightening of said looped portion about said stack.

3. The cover assembly as claimed in claim 2 in which each of said support straps is an integral strap member having a curved portion extending along and fixedly secured to said looped portion of said clamp member.

4. The cover assembly as claimed in claim 3 in which said curved portions of the support straps are fixedly engaged with outer surfaces of said looped portions of said clamp member and extend in opposite directions thereabout.

5. The cover assembly as claimed in claim 1 in which a portion of said bumper means is positioned within said space between said neck formations.

6. The cover assembly as claimed in claim 5 wherein said balance arm includes a pair of stop members for engagement with said bumper means in said respective positions of the pivotal movement.

7. The cover assembly as claimed in claim 1 wherein said balance arm includes a pair of stop members formed thereon for engagement with said bumper means in said respective positions of the pivotal movement.

8. The cover assembly as claimed in claim 1 in which said bumper means comprises an I-shaped member.

9. The cover assembly as claimed in claim 8 in which a portion of said I-shaped member is positioned within the space between said neck formations.

10. The cover assembly as claimed in claim 7 in which said bumper means comprises a central stud and an upper and lower arm, said bumper means being positioned so that said upper and lower arms engage upper and lower edges of said neck formations, respectively, and wherein said upper and lower arms are arranged in the path of movement of said stop members for respective engagement therewith.

11. The cover assembly as claimed in claim 10 in which said stud is positioned in the space between said neck formations.

12. The cover assembly as claimed in claim 11 in which said stud includes an aperture therethrough, and a projection formed on at least one of said neck formations and inserted into said aperture for fixing the position of said bumper means.

* * * * *